US006179572B1

(12) United States Patent
Taguchi

(10) Patent No.: US 6,179,572 B1
(45) Date of Patent: Jan. 30, 2001

(54) DISPLACEMENT CONTROL VALVE MECHANISM OF VARIABLE DISPLACEMENT COMPRESSOR AND COMPRESSOR USING SUCH A MECHANISM

(75) Inventor: Yukihiko Taguchi, Maebashi (JP)

(73) Assignee: Sanden Corporation, Gunma (JP)

( * ) Notice: Under 35 U.S.C. 154(b), the term of this patent shall be extended for 0 days.

(21) Appl. No.: 09/324,843

(22) Filed: Jun. 3, 1999

(30) Foreign Application Priority Data

Jun. 12, 1998 (JP) ..... 10-164554

(51) Int. Cl.[7] ..... F04B 1/26
(52) U.S. Cl. ..... 417/222.2
(58) Field of Search ..... 417/212, 222.2, 417/218, 269; 60/325; 123/501; 92/71

(56) References Cited

U.S. PATENT DOCUMENTS

| | | |
|---|---|---|
| Re. 35,672 | 11/1997 | Taguchi . |
| 4,037,993 | 7/1977 | Roberts . |
| 4,425,837 | 1/1984 | Livesay . |
| 4,480,964 | 11/1984 | Skinner . |
| 4,586,874 | 5/1986 | Hiraga et al. . |
| 4,606,705 | 8/1986 | Parekh . |
| 4,664,604 | 5/1987 | Terauchi . |
| 4,685,866 | 8/1987 | Takenaka et al. . |
| 4,687,419 | 8/1987 | Suzuki et al. . |
| 4,688,997 | 8/1987 | Suzuki et al. . |
| 4,702,677 | 10/1987 | Takenaka et al. . |
| 4,723,891 | 2/1988 | Takenaka et al. . |
| 4,729,719 | 3/1988 | Kayukawa et al. . |
| 4,730,986 | 3/1988 | Kayukawa et al. . |
| 4,747,753 | 5/1988 | Taguchi . |
| 4,778,348 | 10/1988 | Kikuchi et al. . |
| 4,780,059 | 10/1988 | Taguchi . |
| 4,780,060 | 10/1988 | Terauchi . |
| 4,842,488 | 6/1989 | Terauchi . |
| 4,850,810 | 7/1989 | Higuchi et al. . |
| 4,865,523 | 9/1989 | Kikuchi et al. . |
| 4,872,815 | 10/1989 | Takai . |
| 4,874,295 | 10/1989 | Kobayashi et al. . |
| 4,878,817 | 11/1989 | Kikuchi et al. . |
| 4,880,360 | 11/1989 | Terauchi et al. . |
| 4,882,909 | 11/1989 | Terauchi . |
| 4,913,627 | 4/1990 | Terauchi . |
| 4,936,752 | 6/1990 | Terauchi . |
| 4,940,393 | 7/1990 | Taguchi . |
| 4,960,367 | 10/1990 | Terauchi . |

(List continued on next page.)

FOREIGN PATENT DOCUMENTS

| | | |
|---|---|---|
| 197 13 414 | 11/1997 | (DE) . |
| 0219283 | 4/1987 | (EP) . |
| 0536989 | 4/1993 | (EP) . |
| WO9416225 | 7/1994 | (EP) . |
| 4-74549 | 11/1992 | (JP) . |
| 5-99136 | 4/1993 | (JP) . |

OTHER PUBLICATIONS

European Search Report (dated Jan. 13, 2000).

*Primary Examiner*—Teresa Walberg
*Assistant Examiner*—Daniel Robinson
(74) *Attorney, Agent, or Firm*—Baker Botts L.L.P.

(57) ABSTRACT

A variable displacement compressor is provided with a displacement control valve mechanism (93). This displacement control valve mechanism includes a pressure chamber (127) defined from a valve chamber (97), a second passage (89) leading to the pressure chamber and a crank chamber (29), and a valve guide portion (119) which supports a valve body (117) while allowing the valve body inserted therein. This displacement control valve mechanism has one end of the valve body exposed to the pressure chamber, its pressure receiving area being Sc. The variation in the characteristics of this displacement control valve mechanism can be realized by the alteration in Sc, which alteration is practically easy.

10 Claims, 5 Drawing Sheets

U.S. PATENT DOCUMENTS

| | | | | |
|---|---|---|---|---|
| 5,025,636 | | 6/1991 | Terauchi . | |
| 5,027,612 | | 7/1991 | Terauchi . | |
| 5,039,282 | | 8/1991 | Terauchi . | |
| 5,051,067 | | 9/1991 | Terauchi . | |
| 5,064,352 | | 11/1991 | Kiyoshi . | |
| 5,080,561 | | 1/1992 | Taguchi . | |
| 5,092,741 | | 3/1992 | Taguchi . | |
| 5,094,589 | | 3/1992 | Terauchi et al. . | |
| 5,105,728 | | 4/1992 | Hayase et al. . | |
| 5,145,325 | | 9/1992 | Terauchi . | |
| 5,168,716 | | 12/1992 | Terauchi . | |
| 5,189,886 | | 3/1993 | Terauchi . | |
| 5,255,569 | | 10/1993 | Terauchi et al. . | |
| 5,259,736 | | 11/1993 | Terauchi . | |
| 5,282,725 | | 2/1994 | Shimizu . | |
| 5,286,172 | | 2/1994 | Terauchi . | |
| 5,370,503 | | 12/1994 | Terauchi . | |
| 5,425,303 | | 6/1995 | Shimizu et al. . | |
| 5,531,572 | | 7/1996 | Kimura et al. . | |
| 5,584,670 | | 12/1996 | Kawaguchi et al. . | |
| 6,036,447 | * | 3/2000 | Kawaguchi et al. | 417/222.2 |
| 6,102,670 | * | 8/2000 | Taguchi | 417/222.2 |

* cited by examiner

DISPLACEMENT CONTROL VALVE MECHANISM OF VARIABLE DISPLACEMENT COMPRESSOR AND COMPRESSOR USING SUCH A MECHANISM

BACKGROUND OF THE INVENTION (1) Field of the Invention

The present invention relates to a displacement control valve mechanism of a variable displacement compressor used in an air conditioner for an automobile or the like and a variable displacement compressor using such a mechanism.

(2) Prior Art

Conventionally, variable displacement compressors have been used in air conditioners for automobiles and such a compressor is disclosed in Japanese Patent Publication (JP-B) No. 4-74549. In this publication, the variable displacement compressor is disclosed which has its outer frame formed by a cylinder block provided with a plurality of cylinder bores, a front housing mounted on one end of the cylinder block, and a rear housing mounted on the other end of the cylinder block while encasing a valve plate device therein.

A crank chamber is defined between one end of the front housing and one end of the cylinder block. A drive shaft is disposed in the crank chamber. A swash plate mechanism is disposed around the drive shaft. The swash plate mechanism includes a tilting plate, a drive plate, and a rotor. In the swash plate mechanism, the drive plate carries out a tilting movement. The drive plate comes into contact with the tilting plate. The rotor is connected to the drive plate for driving the drive plate. A discharge chamber and a suction chamber are defined in the rear housing.

Inside the bores of the cylinder block, pistons are disposed which are connected to the periphery of one end of the tilting plate through piston rods.

In such a conventional variable displacement compressor, with the adjustment of the pressure in the crank chamber, the inclination angle of the tilting plate is changed so as to change the compressive volume. The pressure control in this crank chamber is carried out by a displacement control valve mechanism mounted in the bottom wall of the other end of the rear housing.

This conventional type of displacement control valve mechanism is called a pressure control valve of an inner control type. With respect to this control valve mechanism, a pressure sensing space and a valve chamber portion are defined in the casing and a pressure sensing member is disposed in the pressure sensing space. The pressure sensing space and a suction chamber are communicated with each other. The valve chamber portion is communicated with discharge chamber by way of a communication hole which is communicated with the discharge chamber and a communication chamber which ensues the communication hole. A through hole is communicated with the crank chamber.

In such a conventional control valve, the pressure sensing member accommodated in the pressure sensing space senses a pressure of the suction chamber and vertically moves a valve body of the valve chamber portion in response to the pressure of the suction chamber. Furthermore, the pressure sensing member adjusts an opened degree of a first passage extending from the discharge chamber to the crank chamber.

In such a conventional displacement control valve mechanism, the pressure control characteristics in the suction chamber of the displacement control valve mechanism is designed such that the pressure in the suction chamber (hereinafter called simply as suction chamber pressure) is changed in response to the pressure in the discharge chamber (hereinafter called simply as discharge chamber pressure).

However, the control characteristics of the suction chamber pressure is determined to have the optimum characteristics in a condition where the compressor is mounted on a vehicle. Accordingly, the optimum characteristics varies depending on vehicles so that the displacement control valve mechanism which has several kinds of control characteristics of the suction chamber pressure becomes necessary.

In one method, the characteristic, i.e., the characteristic curve representing the realizable relationship between the suction chamber pressure and the discharge chamber pressure, is changed by shifting it up and down by adjusting the amount of displacement of a spring inside a bellows portion of the pressure sensing member with an adjustment screw.

Alternately, in another method, the characteristics is optimized by changing the amount of variation of pressure in the suction chamber relative to the pressure in the discharge chamber. In this method, the conventional structure necessitates the change of the seal area of a valve body made of a ball valve or the effective area of the bellows portion.

However, the change or alteration of the effective area of bellows is not preferable in terms of designing since it requires a large design change of the displacement control valve mechanism. On the other hand, in case the seal area of the valve body made of the ball valve is changed, an inflow rate of the discharge gas into the crank chamber is changed so that the rise characteristics of the pressure in the crank chamber is changed. Hence, a problem that the pressure control of the suction chamber becomes unstable, arises.

SUMMARY OF THE INVENTION

It is an object of the present invention to provide a displacement control valve mechanism of a variable displacement compressor which can change the suction pressure control characteristics by changing the amount of variation of the suction pressure relative to the discharge pressure without changing the sealing cross-sectional area of the valve body or the design condition of the bellows portion side.

It is another object of the present invention to provide a variable displacement compressor provided with the above-mentioned displacement control valve mechanism.

According to the present invention, to solve the above-mentioned problems, the provision is constructed such that the amount of variation of the suction chamber pressure is changed relative to the discharge chamber pressure for changing the control characteristics of the suction chamber pressure without changing the seal area of the valve body and the design condition of the bellows portion side.

Namely, according to the present invention, in the displacement control valve mechanism of the variable displacement compressor wherein the valve mechanism is mounted in a compressor including a discharge chamber, a suction chamber and a crank chamber, the valve mechanism comprises a valve chamber communicated with the discharge chamber, pressure sensing means which detects the fluctuation of pressure of either one of the suction chamber or the crank chamber and carries out an extending or retracting movement, and a valve body which is disposed in the valve chamber and is opened or closed in response to the extending or retracting movement for adjusting the valve travel of a first passage leading from the discharge chamber to the crank chamber, and a piston stroke is controlled by adjusting the pressure of the crank chamber, the improvement is characterized in that the displacement control valve mechanism further includes a pressure chamber which is defined as a neighboring chamber of the valve chamber, a second passage which makes the pressure chamber and the crank chamber communicate with each other, and a valve guide portion which defines the pressure chamber and said valve chamber and supports the valve body while allowing an insertion of the valve body therein, and the valve body has one end thereof disposed in the pressure chamber, and a pressure receiving area formed on one end of the valve body and a sealing cross-sectional area formed on the other end of the valve body are set such that they satisfy the variously required suction pressure-discharge pressure characteristics of the displacement control valve mechanism.

In the above-mentioned present invention, the sealing cross-sectional area formed on the other end of the valve body is a pressure receiving surface and comes into contact with a valve seat for the valve body.

Furthermore, according to the present invention, in the displacement control valve mechanism of the variable displacement compressor, the valve body has a cylindrical shape and is formed such that the other end the valve body has a larger cross-sectional area than one end of the valve body.

Still furthermore, according to the present invention, a variable displacement compressor which uses the above-mentioned displacement control valve mechanism of the variable displacement compressor is provided.

DESCRIPTION OF THE PREFERRED EMBODIMENT

Before explaining an embodiment of the present invention, a conventional variable displacement compressor and its displacement control valve mechanism are explained in conjunction with FIGS. 1 to 4 for facilitating the understanding of the present invention.

Figure 1:
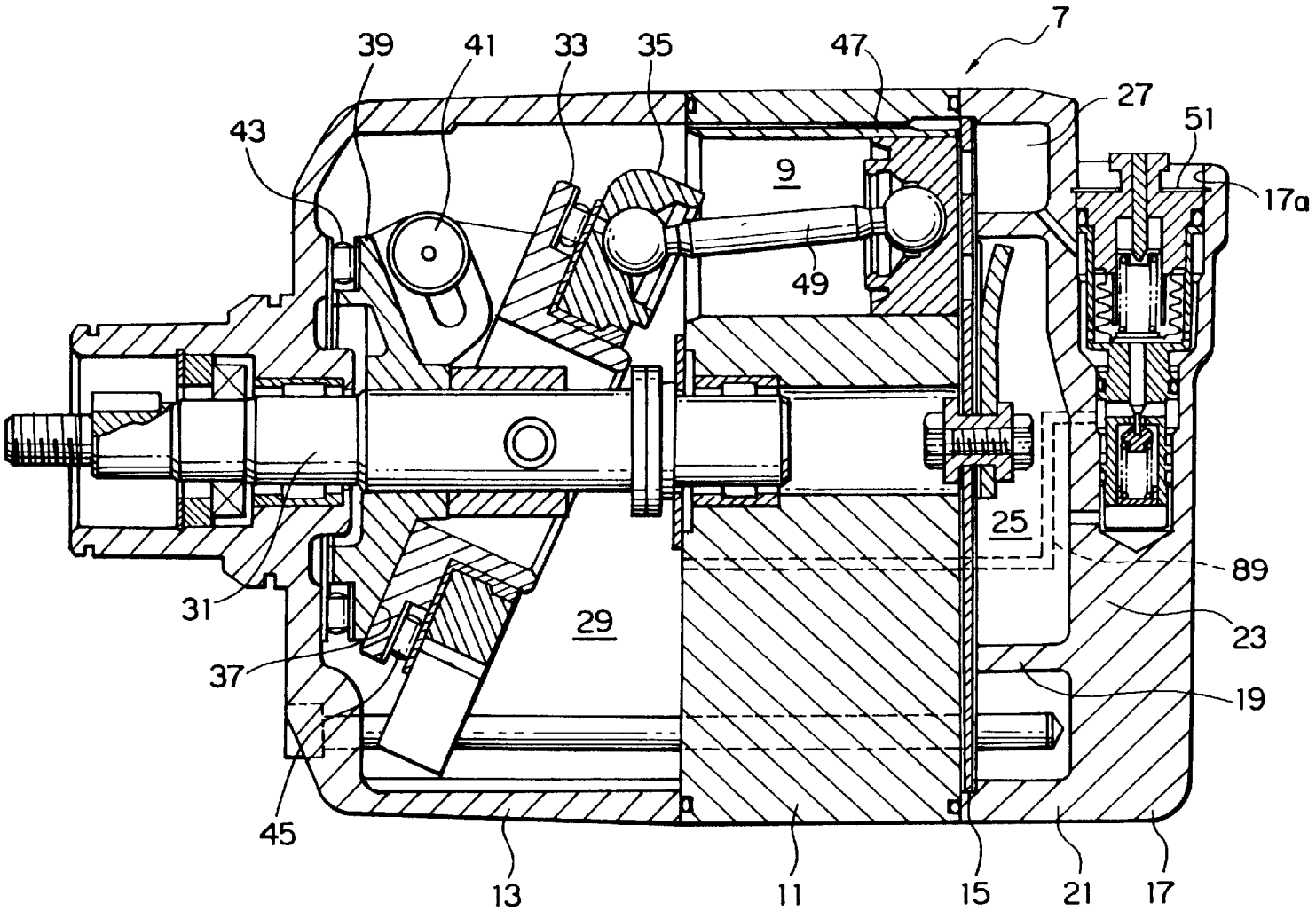
FIG. 1 PRIOR ART
FIG. 1 is a cross-sectional view showing one example of the general construction of a conventional variable displacement compressor.

FIG. 1 is a view showing a variable displacement compressor disclosed in the Japanese Patent Publication (JP-B) No. Hei 4-74549. As shown in FIG. 1, the variable displacement compressor 7 has its outer frame formed by a cylinder block 11 provided with a plurality of cylinder bores 9 arranged in a concentric manner, a front housing 13 mounted on one end of the cylinder block 11 and a rear housing 17 mounted on the other end of the cylinder block 11 while encasing a valve plate device 15 therein. The valve plate device 15 is mounted on the other end of the cylinder block 11 in an abutting manner.

In the rear housing 17, a discharge chamber 25 and a suction chamber 27 are defined by means of the valve plate device 15, an inner wall 19, an outer wall 21 and a bottom wall 23.

A crank chamber 29 is defined between one end of the front housing 13 and one end of the cylinder block 11. A drive shaft 31 is disposed in and passes through the front housing 13 and a swash plate mechanism 33 is disposed around the drive shaft 31. The swash plate mechanism 33 includes a tilting plate 35 which carries out in a direction along the drive shaft 31 a tilting movement with a large movement at the outer peripheral portion thereof and a small movement at the inner side thereof, a drive plate 37 which comes into contact with the tilting plate 35, and a rotor 39 which drives the drive plate 37. The rotor 39 and the drive plate 37 are constructed such that they are interlocked by means of a drive transmission member such as a guide pin 41. In the drawing, numeral 43, 45 respectively indicate thrust bearings.

Pistons 47 are disposed in the cylinder bores 9 of the cylinder block 11 in such a manner that the pistons 47 are slidably movable along the central axes of the cylinder bores 9. The pistons 47 and the peripheral portion of one end of the tilting plate 35 are connected by means of piston rods 49 which are provided with spherical portions at both ends thereof. A displacement control valve mechanism 51 is mounted in the bottom wall 23 of the other end of the rear housing 17.

Figure 2:
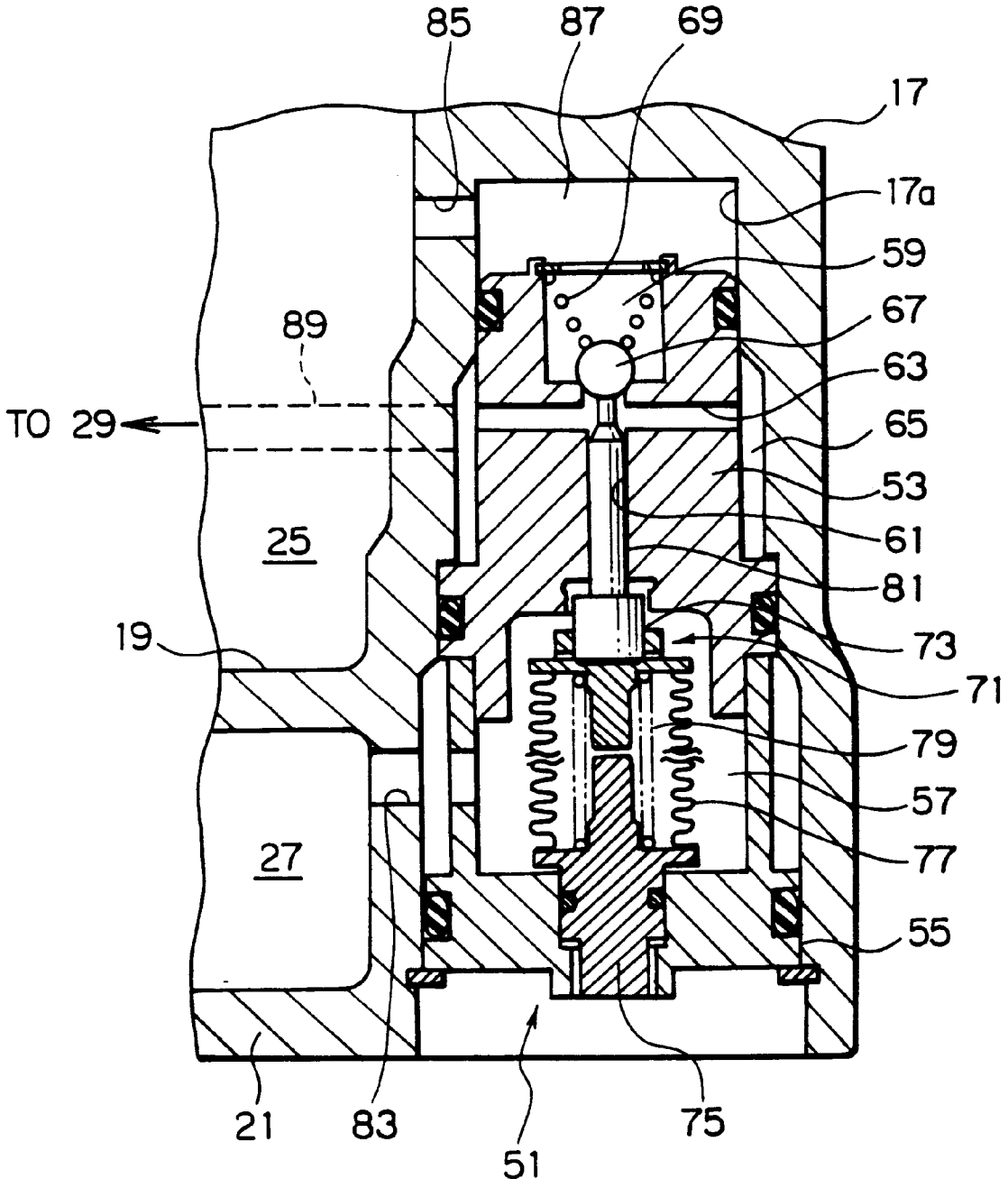
FIG. 2 PRIOR ART
FIG. 2 is a cross-sectional view showing the general construction of a conventional displacement control valve mechanism.

In FIG. 2, the displacement control valve mechanism 51 is shown in an upside-down relationship relative to the displacement control valve mechanism 51 shown in FIG. 1. The displacement control valve mechanism 51 includes a casing body 53 and a cap-shaped lid member 55 which is mounted on one end of the casing body 53. In the other end of the casing body 53, a recess is formed in an axially inward direction to define a valve chamber portion 59, while in one end of the casing body 53, a recess is formed and a pressure sensing space 57 is defined between this recess and the lid member 55. A through hole 61 is formed between the pressure sensing space 57 and the valve chamber portion 59, which are communicated with each other in a longitudinal direction. Another through hole 63 is formed in the casing body 53 in a direction perpendicular to the direction of the through hole 61 and this through hole 63 is communicated with a space 65 surrounding the casing body 53.

Inside the valve chamber portion 59, a valve body 67 is disposed and the valve body 67 is biased toward one end of the through hole 61 or in a downward direction in FIG. 2 by means of a spiral spring 69.

Furthermore, inside the pressure sensing space 57, a pressure sensing member 71 is disposed. The pressure sensing member 71 includes a support member 73, an adjustment screw portion 75, a bellows portion 77 disposed between these two elements, and an inner compression spring 79 disposed inside the bellows portion 77. A transmission rod 81 is disposed in the through hole 61 for making the support member 73 and the valve body 67 communicated with each other. The adjustment screw portion 75 adjusts the displacement position of the bellows 77 in a longitudinal direction (in an up-and-down direction in the drawing).

In the conventional displacement control valve mechanism 51 having the above-mentioned construction, the pressure sensing space 57 and the suction chamber 27 are communicated by way of a communication hole 83, while the valve chamber portion 59 is communicated with the discharge chamber 25 by way of a communication hole 85 which is communicated with the discharge chamber 25 and an ensuing communication chamber 87. Furthermore, the through hole 63 communicated with the crank chamber 29 by way of the space portion 65 and a communication passage 89.

The bellows portion 77 is accommodated in the pressure sensing space 57 and is a so-called a pressure control valve of an inner control type which detects the pressure in the suction chamber 27 and moves the valve body 67 up and down in response to the pressure in the suction chamber 27 and adjusts the valve travel of a first passage extending from the discharge chamber 25 to the crank chamber 29.

In such a displacement control valve mechanism, the force Fv which pushes the valve body 67 made of a ball valve in a valve closing direction and the force Fb which originates from the bellows portion 77 and is transferred through the transmission rod 81 for pushing the ball valve 67 in a valve opening direction are expressed by following formulae (1) and (2), respectively.

$$Fv=(Pd-Pc)\cdot Sv+fv, \tag{1}$$

where:

Pd: discharge chamber pressure

Pc: crank chamber pressure

Ps: suction chamber pressure

Sv: seal area of ball valve

Sb: effective area of bellows

Sr: cross-sectional area of rod fv: biasing force of spring fb: synthetic biasing force of bellows and inner spring $$Fb=fb-\{(Sb-Sr)\cdot Ps+Sr\cdot Pc\} \tag{2}$$

In case of Fv<Pb, the valve body 67 is opened and, a following formula (3) is obtained from the formulae (1) and (2).

$$(Pd-Pc)\cdot Sv+fv<fb-\{(Sb-Sr)\cdot Ps+Sr\cdot Pc\} \tag{3}$$

Here, by setting Pc=Ps+α and putting this value in the above formula (3) and arranging it, a following formula (4) is established.

$$(Sb-Sv)\cdot Ps<-Pd\cdot Sv+fb-fv+(Sv-Sr)\cdot\alpha$$

$$\therefore Ps<\frac{-Sb}{(Sb-Sv)}\cdot Pd+\frac{fb-fv+(Sv-Sr)\cdot\alpha}{(Sb-Sv)} \tag{4}$$

Figure 3:
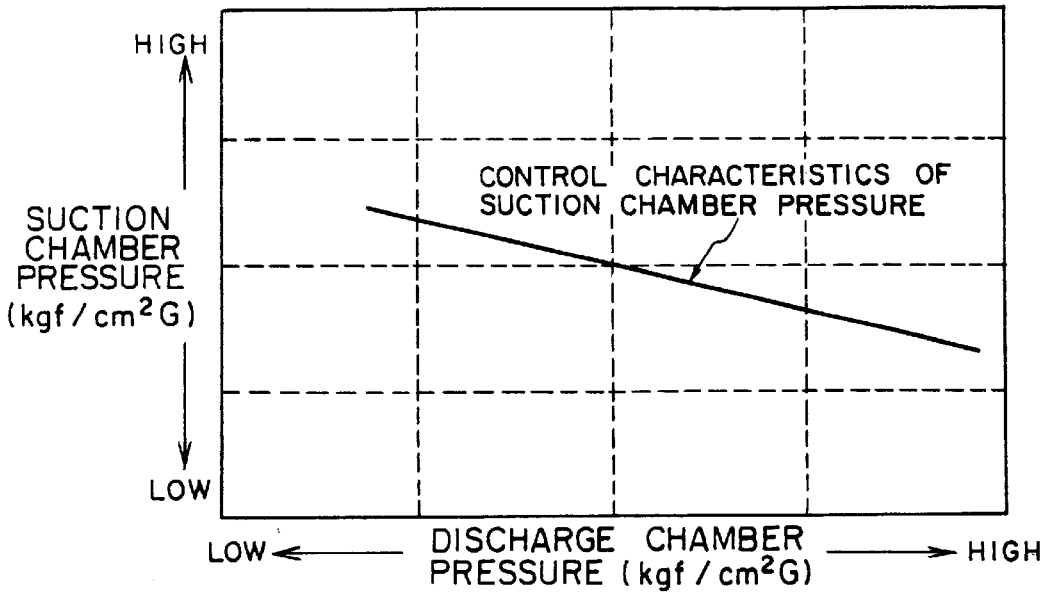
FIG. 3 PRIOR ART
FIG. 3 is a graph showing the suction pressure control characteristics of the displacement control valve mechanism shown in FIG. 2.

The above formula (4) expresses the pressure control characteristics of the inside of the suction chamber of the displacement control valve mechanism. As shown in FIG. 3, this characteristics makes the pressure Ps inside the suction chamber (hereinafter called simply suction chamber pressure) change linearly in response to the pressure Pd inside the discharge chamber (hereinafter called simply discharge chamber pressure).

Since the control characteristics of the suction chamber pressure is determined to have the optimum characteristics in a condition where the compressor is mounted on a specific vehicle, the optimum characteristics varies depending on the sort of vehicles. Accordingly, the displacement control valve mechanism which has several kinds of control characteristics of the suction chamber pressure becomes necessary.

Figure 4:
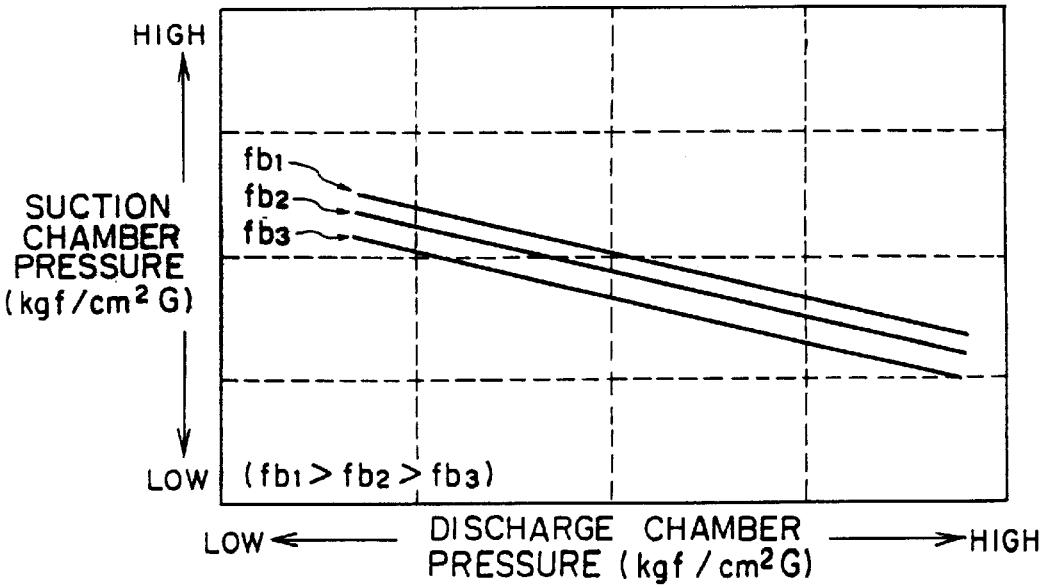
FIG. 4 PRIOR ART
FIG. 4 is a graph provided for explaining the manner of changing the characteristics of the displacement control valve mechanism.

For example, as shown in FIG. 4, to meet the air conditioning performance requirement specified by the kind of the vehicle, the characteristics can be shifted and thus changed by adjusting the amount of displacement of the spring 79 inside the bellows portion 77 (see FIG. 2) with an adjustment screw 75. Alternately, in another method, the characteristics is optimized by changing the amount of variation of pressure in the suction chamber 27 relative to the pressure in the discharge chamber 25. In this method, the conventional structure necessitates the change of the seal area Sv of a valve body 67 made of a ball valve or the effective area Sb of the bellows portion 77. Here, the seal area Sv and the effective area Sb determine the coefficient of Pd in the formula (4).

However, the change or alteration of the effective area Sb of the bellows portion 77 is not preferable in terms of designing since it requires a large design change of the displacement control valve mechanism 51. On the other hand, in case the seal area Sv of the valve body 67 made of the ball valve is changed, an inflow rate of the discharge gas into the crank chamber 29 is changed so that the rise characteristics of the pressure in the crank chamber 29 is changed. Hence, a problem that the pressure control of the suction chamber 27 becomes unstable, arises.

The embodiment of the present invention is hereinafter explained in view of FIGS. 5 and 6. The compressor according to the embodiment of the present invention has the similar construction as that of the conventional compressor except for the displacement control valve mechanism. Hence, the explanation of the compressor is omitted and only the displacement control valve mechanism is explained.

Figure 5:
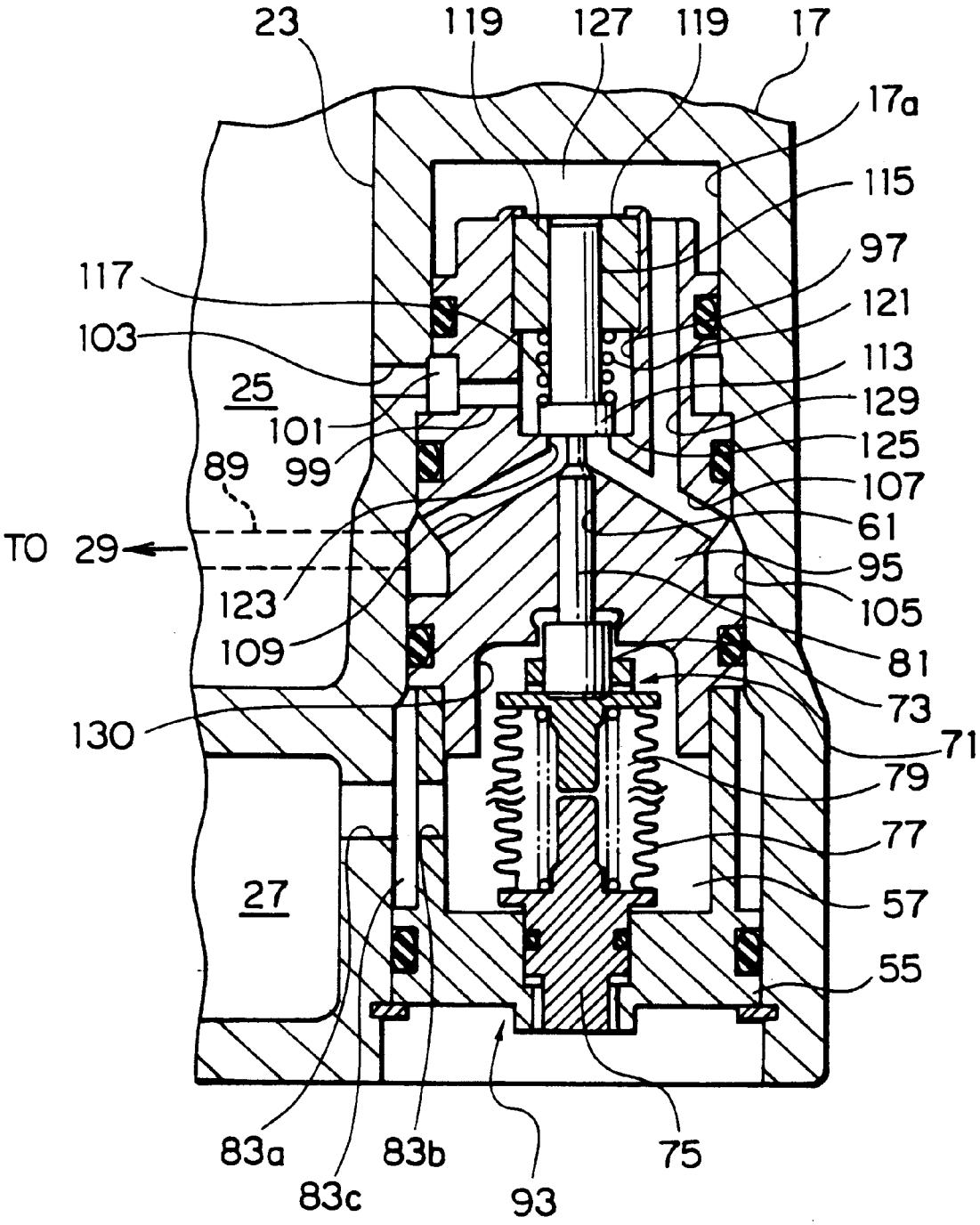
FIG. 5 is cross-sectional view of a displacement control valve mechanism according to an embodiment of the present invention.

In FIG. 5, like parts which are also provided to the conventional displacement control valve mechanism are indicated by the same symbols. As shown in FIG. 5, the displacement control valve mechanism 93 includes a casing body 95 and a lid member 55. A valve chamber 97 is formed in one end of the casing body 95. This valve chamber 97 is communicated with a recess 130 formed in the other end of the casing body 95 by way of a through hole 61. The valve chamber 97 reaches the side or peripheral surface of the casing body 95 by way of a communicating hole 99. A cylindrical or annular hollow portion 101 is formed between the portion of the casing body 95 which surrounds the communicating hole 99 and an accommodating portion 17*a* of the rear housing 17. The cylindrical hollow portion 101 is communicated with the discharge chamber 25 by way of a communication hole 103. Between the discharge chamber 25 and the crank chamber 29, a first passage is provided which is formed by a communication passage 89, an annular hollow passage 105, through holes 107, 109, the valve chamber 97, the communication hole 99, the cylindrical hollow portion 101 and the communication hole 103.

Inside the valve chamber 97, a valve body 117 is disposed which is made of a cylindrical member. The valve body 117 is comprised of a large diameter portion 113 having a large diameter extremity and an intermediate diameter portion 115 having a diameter smaller than the large diameter portion 113. At the inlet side formed in the upper end of the valve chamber 97, a cylindrical valve guide 119 is disposed in such a manner that it cannot be removed. Between the valve guide 119 and the large diameter portion 113 and around the intermediate diameter portion 115, a coil spring 121 is disposed. The coil spring 121 biases the valve body 117 so as to make the valve body 117 close an opening 123 formed in the bottom portion of the recess, namely a valve seat 125. The intermediate diameter portion 115 has a portion thereof slidably inserted and disposed in the valve guide 119. A pressure chamber 127 is defined between the upper end of the casing body 95 and the inner wall portion of the accommodating portion 17*a*.

A plurality of holes are branched off from the opening 123 formed in the bottom portion of the valve chamber 97. One hole is communicated with a recess 130 formed in the other end of the casing body 95 as a through hole 61, while other holes define through holes 107, 109 which extend downwardly in an inclined manner in the casing body 95. The through holes 107, 109 reach the side surface or the peripheral surface of the casing body 95 and are communicated with the annular hollow portion 105 defined between the side surface of the casing body 95 and the accommodating portion 17*a*. This annular hollow portion 105 is communicated with the crank chamber 29 by way of the communication passage 89.

Furthermore, one through hole 107 has a midst portion thereof communicated with the pressure chamber 127 formed on the upper end of the casing body 95 by way of a communication passage 129 which passes through the inside of the casing body 95. Accordingly, the crank chamber 29 and the pressure chamber 127 are always communicated with each other by way of the communication passage 89, the annular hollow portion 105, the through holes 107, 109 and the communication passage 129 which constitute a second passage.

The valve body 117 is inserted into the valve guide 119 and receives the pressure in the pressure chamber 127 on one end thereof. Accordingly, the pressure in the crank chamber 29 acting on the contact surface between the valve body 117 and the valve seat 125 is acting on the upper end surface of the valve body 117 by the communication passage 129.

As a result, a force Fv which pushes the valve body 117 in a valve closing direction and a force Fb which originates from the bellows portion 77, is transferred through the transmission rod 81, and pushes the valve body 117 in a valve opening direction are respectively expressed by following formulae (5) and (6).

$$Fv=(Pd-Pc)\ (Sv-Sc)+fv; \tag{5}$$

where:

Pd: discharge chamber pressure

Sv: seal area of valve body

Pc: crank chamber pressure

Ps: suction chamber pressure fb: synthetic biasing force of bellows and inner spring fv: biasing force of spring Sb: effective area of bellows Sr: cross-sectional area of rod Sc: pressure receiving area of pressure chamber side of valve body $$Fb=fb-\{(Sb-Sr)\cdot Ps+Sr\cdot Pc\} \tag{6}$$

In case of Fv<Fb, the valve body 117 is opened and, a following formula (7) is obtained from the formulae (5) and (6).

$$(Pd-Pc)\cdot(Sv-Sc)+fv<fb-\{(Sb-Sr)\cdot Ps+Sr\cdot Pc\} \tag{7}$$

Here, by setting Pc=Ps+α and putting this value in the above formula (7) and arranging it, a following formula (8) is obtained.

$$\{Sb-(Sv-Sc)\}\cdot Ps<-Pd\cdot(Sv-Sc)+fb-fv+(Sv-Sc-Sr)\cdot\alpha$$

$$\therefore Ps<\frac{-(Sv-Sc)}{Sb-(Sv-Sc)}\cdot Pd+\frac{fb-fv+(Sv-Sc-Sr)\cdot\alpha}{Sb-(Sv-Sc)} \tag{8}$$

The above formula (8) expresses the pressure control characteristics of the displacement control valve mechanism according to the embodiment of the present invention.

Figure 6:
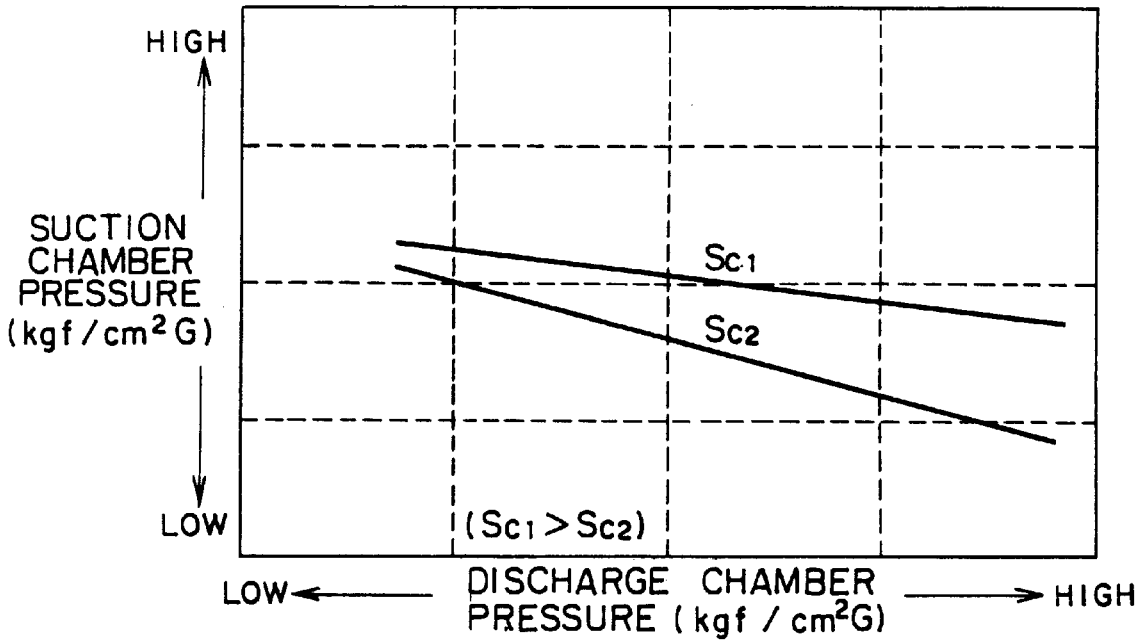
FIG. 6 is a graph showing the suction pressure control characteristics of the displacement control valve mechanism shown in FIG. 5.

With reference to the coefficient of Pd in the formula (8), without changing the effective area (Sb) of the bellows and the seal area (Sv) of the valve body, the variation of the suction chamber pressure relative to the discharge chamber pressure can be changed by changing the pressure receiving area (Sc) of pressure chamber 127 side of the valve body 117, as shown in FIG. 6.

Furthermore, the displacement control valve mechanism exhibits the characteristics that in case of Sv>Sc, as the discharge chamber pressure is increased, the suction chamber pressure is decreased, while in case of Sv<Sc, as the discharge chamber pressure is increased, the suction chamber pressure is increased.

As has been described heretofore in conjunction with the embodiment, the present invention can provide the displacement control valve mechanism of the variable displacement compressor which can alter the suction pressure control characteristics by changing the amount of variation of the suction pressure relative to the discharge pressure without changing the seal area of the valve body and the design condition of the bellows side. In other words, the displacement control valve mechanism according to the present invention can alter the suction pressure control characteristics by an alteration of pressure receiving area Sc of the rod 117. And in practice, this alteration can be easily done by changing the diameter of intermediate diameter portion 115 and the corresponding diameter of the inner wall of the cylindrical valve guide 119.

Furthermore, the present invention can also provide the variable displacement compressor provided with the displacement control valve mechanism with above-mentioned advantages.

What is claimed is:

1. A variable displacement compressor comprising a tilting plate disposed around a rotary shaft disposed in a crank chamber and carrying out a tilting movement, pistons which carry out a reciprocating movement in cylinder bores due to said tilting movement of said tilting plate, suck a fluid to be compressed from a suction chamber and compress said fluid and feed said fluid to a discharge chamber, and a displacement control valve mechanism for controlling the stroke of said pistons by varying the inclination angle of said tilting plate with an adjustment of pressure in said crank chamber;

said displacement control valve mechanism comprising a valve chamber communicated with said discharge chamber, pressure sensing means which senses the pressure fluctuation of either one of said suction chamber or said crank chamber and carries out an extending or retracting movement, and a valve body disposed in said valve chamber and is opened or closed in response to said extending or retracting movement and adjusts a valve travel of a first passage from said discharge chamber to said crank chamber, said displacement control valve mechanism further including a pressure chamber which is defined as a neighboring chamber of said valve chamber, a second passage which makes said pressure chamber and said crank chamber communicate with each other, and a valve guide portion which defines said pressure chamber and supports said valve body while allowing an insertion of said valve body therein, said valve body having one end disposed in said pressure chamber and the other end opposite to said one end, said one end having a pressure receiving area, said other end having a sealing cross-sectional area, said pressure receiving and said sealing cross-sectional areas being determined such that they satisfy the variously required suction pressure-discharge pressure characteristics of said displacement control valve mechanism.

2. A variable displacement compressor as claimed in claim 1, wherein said valve body has a cylindrical shape and is formed such that said other end of said valve body has a larger cross-sectional area than said one end of said valve body.

3. A variable displacement compressor as claimed in claim 2, wherein said discharge chamber and said valve chamber are always connected to each other via said second passage.

4. A variable displacement compressor as claimed in claim 3, wherein a passage from said valve body to said crank chamber makes an acute angle with a moving direction of said valve body in said second passage.

5. A displacement control valve mechanism of a variable displacement compressor, said compressor including a discharge chamber, a suction chamber and a crank chamber;

said valve mechanism being mounted in the compressor and comprising a valve chamber communicated with said discharge chamber, pressure sensing means which detects the fluctuation of pressure of either one of said suction chamber or said crank chamber and carries out an extending or retracting movement, and a valve body which is disposed in said valve chamber and is opened or closed in response to said extending or retracting movement for adjusting the valve travel of a first passage leading from said discharge chamber to said crank chamber;

a piston stroke being controlled by adjusting the pressure of said crank chamber;

said displacement control valve mechanism further including a pressure chamber which is defined as a neighboring chamber of said valve chamber, a second passage which makes said pressure chamber and said crank chamber communicate with each other, and a valve guide portion which defines said pressure chamber and said valve chamber and supports said valve body while allowing an insertion of the valve body therein;

said valve body having one end thereof disposed in said pressure chamber and the other end opposite to said one end, said one end having a pressure receiving area formed on one end of said valve body, said other end having a sealing cross-sectional area formed on the other end of said valve body, said pressure receiving and said sealing cross-sectional areas being determined such that they satisfy the variously required suction pressure-discharge pressure characteristics of said displacement control valve mechanism.

6. A displacement control valve mechanism as claimed in claim 5, wherein said valve body has a cylindrical shape and is formed such that said other end of said valve body has a larger cross-sectional area than said one end of said valve body.

7. A displacement control valve mechanism as claimed in claim 6, wherein said discharge chamber and said valve chamber are always connected to each other via said second passage.

8. A displacement control valve mechanism as claimed in claim 7, wherein a passage formed from said valve body to said crank chamber in said valve body makes an acute angle with a moving direction of said valve body in said second passage.

9. A method of controlling a variable displacement of compressor, said compressor comprising a tilting plate disposed around a rotary shaft disposed in a crank chamber and carrying out a tilting movement, pistons which carry out a reciprocating movement in cylinder bores due to said tilting movement of said tilting plate, suck a fluid to be compressed from a suction chamber and compress said fluid and feed said fluid to a discharge chamber, and a displacement control valve mechanism for controlling the stroke of said pistons by varying the inclination angle of said tilting plate with an adjustment of pressure in said crank chamber, said displacement control valve mechanism comprising a valve chamber communicated with said discharge chamber, pressure sensing means which senses the pressure fluctuation of either one of said suction chamber or said crank chamber and carries out an extending or retracting movement, and a valve body disposed in said valve chamber and is opened or closed in response to said extending or retracting movement and adjusts a valve travel of a first passage from said discharge chamber to said crank chamber, said displacement control valve mechanism further including a pressure chamber which is defined as a neighboring chamber of said valve chamber, a second passage which makes said pressure chamber and said crank chamber communicate with each other, and a valve guide portion which defines said pressure chamber and supports said valve body while allowing an insertion of said valve body therein, said valve body having one end disposed in said pressure chamber and the other end opposite to said one end, said one end having a pressure receiving area, said other end having a sealing cross-sectional area;

said method comprising a step of determining said pressure receiving and said sealing cross-sectional areas such that they satisfy the variously required suction pressure-discharge pressure characteristics of said displacement control valve mechanism.

10. A method as claimed in claim 9, further comprising steps of forming said valve body to have a cylindrical shape and forming said valve body such that said other end of said valve body has a larger cross-sectional area than said one end of said valve body.

* * * * *